US006324354B1

(12) United States Patent
Tode et al.

(10) Patent No.: US 6,324,354 B1
(45) Date of Patent: Nov. 27, 2001

(54) IMAGE FORMING PROCESS AND AN IMAGE FORMING APPARATUS

(75) Inventors: Hiroyoshi Tode; Masayoshi Yamada; Eiji Ochiai, all of Watarai-gun (JP)

(73) Assignee: Kyocera Corporation, Kyoto (JP)

( * ) Notice: Subject to any disclaimer, the term of this patent is extended or adjusted under 35 U.S.C. 154(b) by 0 days.

(21) Appl. No.: 09/507,880

(22) Filed: Feb. 22, 2000

(30) Foreign Application Priority Data

| | | |
|---|---|---|
| Feb. 22, 1999 | (JP) | 11-043717 |
| Mar. 15, 1999 | (JP) | 11-068035 |
| Dec. 28, 1999 | (JP) | 11-375159 |
| Dec. 28, 1999 | (JP) | 11-375160 |

(51) Int. Cl.[7] ..... G03G 15/08
(52) U.S. Cl. ..... 399/29; 399/53
(58) Field of Search ..... 399/29, 43, 44, 399/53, 55, 99, 257, 264, 270, 273, 283, 285

(56) References Cited

U.S. PATENT DOCUMENTS

| | | | | |
|---|---|---|---|---|
| 5,162,849 | * | 11/1992 | Yoshino et al. | 399/29 |
| 5,175,070 | | 12/1992 | Tanikawa et al. . | |
| 5,202,731 | | 4/1993 | Tanikawa et al. . | |
| 5,692,232 | * | 11/1997 | Okano et al. | 399/53 |
| 5,970,280 | * | 10/1999 | Suzuki et al. | 399/55 |

FOREIGN PATENT DOCUMENTS 2-176685 9/1990 (JP) .

* cited by examiner

*Primary Examiner*—Sandra Brase
(74) *Attorney, Agent, or Firm*—Schulte Roth & Zabel

(57) ABSTRACT

The present invention relates to an image forming process and an image forming apparatus, which have a refresh means which refreshes the developing sleeve by allowing the toner on the developing sleeve to jump toward the photoreceptor drum when transfer to recording medium is not done.

Refresh is performed by applying an AC bias between the photoreceptor drum and the developing sleeve.

The number of dots of latent image corresponding to actual image pattern is counted and the ratio of this number of dots to the number of dots corresponding to full black original image is defined as print rate, and cumulative average print rate is calculated each time when a page or a predetermined number of pages is printed.

When the average print rate falls short of proper print rate, refresh is performed. It is suitable to set several proper print rate, and the duration of application of the AC bias is varied according to the average print rate.

It is also effective to apply AC bias for refresh higher in effective voltage than applied for developing.

It is also effective to prevent "fog" by applying transfer reverse bias to transfer part until the toner on the photoreceptor passes the transfer part and transfer positive bias after cleaning of the toner on the photoreceptor is finished.

Generally, when an image forming apparatus is used for an extended period of time or when low print rate original image is copied in large quantity, deterioration such as reduction in print density and "fog" is liable to occur.

According to the present invention, even if images of low print rate is copied in large quantity, deterioration does not occur.

78 Claims, 10 Drawing Sheets

IMAGE FORMING PROCESS AND AN IMAGE FORMING APPARATUS

BACKGROUND OF THE INVENTION

1. Field of the Invention

The present invention relates to an image forming process and an image forming apparatus, having a toner carrier which faces an electrostatic latent image carrier and carries toner to the developing zone thereon, and provided with a refresh means which refreshes the toner on the toner carrier when image transfer to a recording medium is not done or when the apparatus is in a state of not transferring image.

2. Description of the Related Art

Generally, by repetition of image forming with a developing apparatus which uses uni-component developer, toner of small grain size sticks to the surf ace of the toner carrier attracted by mirror-image force caused by high electrification thereof, the stuck toner hinders another toner from being charged by frictional contact with the surface of the toner carrier, and toner may be carried as far as the latent image on the electrostatic latent image carrier without being charged uniformly on the toner carrier.

This may cause problems such as light density of image and "fog".

The phenomenon like this is furthered in a case where the image to be formed is of low print rate, because toner particles are liable to remain on the toner carrier (developing sleeve), for small quantity of toner jumps from the toner carrier to the electrostatic latent image zone on the image carrier (photoreceptor drum), effecting reduction in print density and "fog".

It is possible, in these cases, to alleviate the phenomenon by letting the toner jump in quantity from the developing sleeve to the photoreceptor drum by performing image forming of high print rate image pattern such as black solid fills and transferring the toner to the recording medium to consume the toner on the developing sleeve; however, in a case where black solid fills print is not done after the apparatus is left standing without consuming the toner for an extended period, the toner particles, affected by humidity and others, adheres to the surface of the developing sleeve and may not be able to be recovered. The phenomenon is liable to occur especially under high humidity conditions.

Heretofore, studies on the shape of surface and material of the toner carrier have been carried on, improvements have been made to make enough use of the capabilities of charging toner; however, in some cases toner is charged excessively and the phenomenon described above is easy to occur.

In the developing zone, toner reciprocates between the electrostatic latent image and the toner carrier by applying an AC bias.

Accordingly, by applying a higher AC bias when developing is not executed than when development is executed, the toner is removed from the toner carrier and allowed to jump to the electrostatic latent image.

Therefore, in cases where the print rate is low, that is, the number of dots of the image is small, deterioration in transferred image is prevented by applying an alternating electric field to the toner carrier to consume the toner thereon after the formation of the image, by which the surface of the toner carrier is refreshed.

However, there are drawbacks that the effect is not expected unless applying period of the alternating electric field is long, because, after the apparatus is left standing over an extended period of time, the toner is removed in consecutive order from the surface layer, and a lot of the toner is consumed, which means it is not efficient and economical.

Further, in some cases, as the alternating electric field is applied to the toner carrier and the electrostatic latent image zone when refresh is performed, the reverse-charged toner in the a developing device attaches to the transfer part and pollute the reverse side of the printing sheet. In high humidity condition the reverse-charged toner may be mixed in the positive-charged toner, which raises the like problem as mentioned above.

SUMMARY OF THE INVENTION

An object of the present invention is, in light of such problems as mentioned above, to provide a process and an apparatus, which eliminate image defectiveness such as reductions in image density, fog, and pollution of the reverse side of the printing sheet, by making it possible that the grain size distribution of toner particles on the toner carrier does not vary even after an extended period of use of the apparatus, by enabling a thin, uniform layer of toner to be formed on the toner carrier by removing the residual toner thereon through performing refresh as necessary.

Another object of the present invention is to provide a process and an apparatus for forming image, which solve the problem of image deterioration while minimizing consumption of the toner.

The present invention provides a process and an apparatus for forming image, in which a toner carrier which faces an electrostatic latent image carrier and carries toner to the developing zone thereon is provided; and refresh of the toner on the toner carrier is performed when image transfer to a recording medium is not done, that is, after transfer of the toner image on the electrostatic latent image carrier to the recording medium is finished.

The present invention provides an image forming process, in an image forming apparatus having atoner carrier which faces an electrostatic latent image carrier and carries toner to the developing zone thereon, having a refresh process in which an alternating electric field for refresh is applied between said electrostatic latent image carrier and said toner carrier to it refresh the surface of said toner carrier by carrying the toner on said toner carrier to said electrostatic latent image carrier side when the image is not transferred to a recording medium, wherein said refresh process is performed in a case where print rate of image falls short of proper print rate.

To effectuate the refresh process, an image forming apparatus according to the present invention is provided with a toner carrier which faces an electrostatic latent image carrier and carries toner to the developing zone thereon, and refresh of the toner on the toner carrier is performed when image transfer to a recording medium is not executed, wherein a print rate processing means which processes numerically the print rate corresponding to image pattern; and a refresh means which applies an alternating electric field for refresh between the electrostatic latent image carrier and the toner carrier to carry the toner thereon to the electrostatic latent image carrier side when the print rate falls short of the proper print rate; are provided.

After repetition of image forming by the electrostatic latent image carrier and the toner carrier, the amount of toner which remains on the toner carrier is large when the print rate falls short of proper print rate, as the toner which jumps from the toner carrier to the electrostatic latent image carrier is smaller in quantity than when the print rate is higher.

When left standing in this state, the toner particles adhere to the surface of the toner carrier and may not be recovered.

The surface of the toner carrier is cleaned; by providing a print rate processing means which processes numerically the print rate corresponding to the image pattern, and a refresh means which applies an alternating electric field between the electrostatic latent image carrier and the toner carrier to carry the toner thereon to the electrostatic latent image carrier side when the print rate falls short of a proper print rate; by obtaining, counting the number of dots for forming the electrostatic latent image corresponding to the actual image pattern, print rate defined as the ratio of the counted number of dots to that required for forming a black solid fills image; and through refresh by the refresh means which allows the toner on the toner carrier to jump to the electrostatic latent image carrier, after transfer of the toner image on the electrostatic latent image carrier to the recording medium is finished, when the print rate falls short of proper print rate. The toner attached to the surface of the electrostatic latent image carrier can be cleaned by a cleaning means for the electrostatic latent image carrier.

The refresh may be performed following the completion of image formation on a sheet of recording medium, or following the completion of image formation of set number of sheets (for example, 64 sheets, 100 sheets, etc.) after the number of the sheets on which image formed reach proper number. The refresh may be performed, providing sensors for measuring temperature and humidity in the developing device, when the temperature and/or the humidity exceeds each proper value, or when print rate of image falls short of proper print rate and also the temperature and/or the humidity exceeds each proper value.

In a case the refresh is performed after image forming is finished, users may doubt, as the machine works for the refresh after image forming operation is finished, as if the machine is out of order.

So it may be suitable to provide a memory for memorizing the necessity of refresh and perform the refresh referring to the memory, when next printing is instructed, before the printing begins.

It may be also suitable to finish refresh within a fixed time period after source switch is shut off, and then the apparatus may fall into a standby state or completely shut-off state.

It may be also suitable to perform the refresh within a fixed time period after the electric source is switched on, that is, at the same time with warming-up. It is also suitable to perform the refresh by user's direction sending the command from the front panel or computer, according to situations.

It is also an effective means of the present invention to control the applying time period of the alternating electric field for refresh according to the print rate of image.

It is preferable that the lower the print rate, the longer the applying time period of the alternating electric field for refresh, for the lower the print rate, the smaller the quantity of the toner which jumps from the toner carrier to the electrostatic latent image carrier.

The present invention also provides an image forming process, in an image forming apparatus having a toner carrier which faces an electrostatic latent image carrier and carries toner to the developing zone thereon, having a refresh process in which an alternating electric field for refresh is applied between said electrostatic latent image carrier and said toner carrier to refresh the surface of said toner carrier by carrying the toner on said toner carrier to said electrostatic latent image carrier side when the image is not transferred to a recording medium, wherein the number of pages of the recording medium is counted;

print rate of image is computed and average print rate is obtained;

proper number of pages is counted and when said average print rate falls short of the proper print rate, said refresh process is performed.

Here, "proper number of pages is counted and when the average print rate falls short of the proper print rate" includes the cases shown below:

(a) The average print rate falls short of the proper print rate when the number of pages has reached the proper number of pages.

(b) The average print rate falls short of the proper print rate after the number of pages reached the proper number of pages.

(c) The average print rate falls short of the proper print rate before the number of pages reaches the proper number of pages.

Count of the number of pages may be continued until the refresh process is finished or reset when the proper number of pages counted to again start count from the first sheet of the next printing.

Usually, there may occur a case where the print rate is lower than the proper print rate, but continuous printing averages the print rate, so it is preferable to perform refresh judging the necessity of refresh from not only the print rate but also from the number of pages of recording medium, when the apparatus is not left standing for an extended period. However, occurrence of the case (b) and (c) is more frequent than that of the case (a), and so, generally, the print rate shows various values when the proper number of pages is reached.

The necessary applying period of the alternating electric field for refresh differs according to the value of the print rate. By controlling the applying period of the alternating electric field, the applying period can be matched to the necessary period.

To effectuate the refresh, an image forming apparatus according to the present invention provides a toner carrier which faces an electrostatic latent image carrier and carries is toner to the developing zone thereon, and performs refresh of the toner on said toner carrier when image transfer to a recording medium is not executed, wherein a counting means for counting the number of pages of the recording medium;

an average print rate processing means for obtaining average print rate by numerically processing print rate corresponding to image pattern; and a refresh means which applies an alternating electric field for refresh between said electrostatic latent image carrier and said toner carrier to carry toner on the said toner carrier to the said electrostatic latent image carrier side when said print rate falls short of proper print rate; are provided, and said refresh means is actuated in a case where the average print rate calculated by said average print rate processing means falls short of proper print rate when proper number of pages is counted.

It is also an effective means of present invention to configure so that the applying time period of the alternating electric field for refresh is controlled according to the average print rate.

It is not necessary to apply the alternating electric field for refresh for the same predetermined time period, but is preferable to control the applying period.

The proper print rate is preferable to be 3%.

As shown in FIG. 9, the image density in print evaluation reduces when the print rate falls short of 3%.

The processes detailed heretofore assume the refresh to be performed while the toner carrier is rotated. When the toner remains thick on the toner carrier, only outermost layer may be removed during the rotation of the toner carrier necessitating several rotations of the toner carrier for complete removal of the toner.

Application of the bias while the main motor for driving to the electrostatic latent image carrier and the toner carrier is shut down make it possible to remove the strongly charged its toner layer nearest to the surface of the toner carrier; it reduces toner consumption effectively, and the refresh is performed economically.

The present invention provides, to perform the refresh described above, an image forming process, in an image forming apparatus having a toner carrier which faces an electrostatic latent image carrier and carries toner to the developing zone thereon, having a refresh process in which an alternating electric field for refresh is applied between said electrostatic latent image carrier and said toner carrier to refresh the surface of said toner carrier by carrying the toner on said toner carrier to said electrostatic latent image carrier side when the image is not transferred to a recording medium, wherein:

average print rate is obtained every time an image is formed on recording medium; and refresh of the surface of said toner carrier is performed, rotating said electrostatic latent image carrier after application of said alternating electric field for refresh while the rotation of said electrostatic image carrier and said toner carrier being stopped when said average print rate falls short of proper print rate.

To effectuate the refresh, an image forming apparatus according to the present invention provides an image forming apparatus having a toner carrier which faces an electrostatic latent image carrier and carries toner to the developing zone thereon, and performs refresh of the toner on said toner carrier when image transfer to a recording medium is not executed, wherein an average print rate processing means which computes average print rate corresponding to image pattern every time image formation on recording medium is performed;

a rotation control means to control rotation of said electrostatic latent image carrier and said toner carrier; and a refresh means which applies an alternating electric field for refresh between said electrostatic latent image carrier and said toner carrier to carry the toner on said toner carrier, which toner exists on the part thereof facing said electrostatic latent image carrier, to said electrostatic latent image carrier side, while said electrostatic latent image carrier and said toner carrier are stopped of their rotations, when said print rate falls short of proper print rate; are provided, and refresh of the surface of said toner carrier is performed, rotating said electrostatic latent image carrier after said alternating electric field for refresh is applied.

More clearly, the apparatus is provided with an average print rate processing means which processes numerically the print rate corresponding to an image pattern on a page of a document every time an image is formed on a recording medium and calculates the cumulative average print rate, a rotation control means which control the rotations of the electrostatic latent image carrier and the toner carrier, and a refresh means which apply an alternating electric field for refresh between the electrostatic latent image carrier and the toner carrier; counts the number of dots which forms a latent image on the electrostatic latent image carrier corresponding to an image pattern of a page of a document and obtain a print rate defined as the ratio of the number of dots used to form a latent image corresponding to a document image to the number of dots required to form a latent image corresponding to a black solid fills page; and accumulated print rate is divided by the number of printed pages to obtain cumulative average print rate.

When the average print rate of the document images falls short of the proper print rate, the electrostatic latent image carrier and the toner carrier are stopped of their rotations after the toner on the electrostatic latent carrier is transferred to recording medium, and the toner existing on the toner carrier at the zone which faces the electrostatic latent image carrier is refreshed by making the toner jump to the electrostatic image carrier by the refresh means. Thus the surface of the toner carrier is cleaned and the toner attached to the surface of the electrostatic latent image carrier can be cleaned by the cleaning means for electrostatic latent image carrier.

It is preferable the alternating electric field for refresh is applied for longer than 50 msec.

It is also an effective means of the present invention to configure so that the toner carrier is rotated to refresh the remaining surface thereof after the electrostatic latent image carrier is rotated for a set period of time.

To effectuate this, it is preferable to construct so that the refresh means includes an application duration control means which controls the period during which the alternating electric field for refresh is applied.

It is also an effective means of the present invention that the surface of the toner carrier is divided in several zones with a proper central angle and each zone is refreshed per rotation of the proper angle.

To effectuate this, it is preferable that the rotation in control means includes a step-advance means which rotates stepwise the toner carrier, of which the surface is divided in several zones with a proper central angle, in synchronization with the end of application of the alternating electric field for refresh.

It is also an effective means of the present invention that the dividing angle is the angle from the developing position of the electrostatic latent image carrier to cleaning position and refresh each rotation of the toner carrier by said angle is repeated for a set period of time.

To effectuate this, it is preferable that the rotation control means includes a means which repeats refresh each rotation by said angle for a set period of time.

When the toner is agitated in a temperature state higher than a certain temperature and continued to be left standing, especially when the chance of removing off the toner on the developing roller is small, the toner is excessively charged; as a result the toner coheres or flocculates by heat like soft cake, unable to be charged, and the image density may reduces.

Further, when humidity is high, electric leak occurs, toner is unable to be charged enough, and image density may reduces; in the case of low print rate, the toner is excessively charged near the surface of the toner carrier, uncharged in the surface layer of the toner, thus balance of charge on the developing roller collapses extremely and image forming may not be effected.

So it is effective to perform refresh when the temperature or the humidity exceeds a proper limit. To effectuate this, it is preferable to place temperature and humidity sensors in the developing device and provide a means which let refresh be performed when the sensors detected higher temperature and humidity than each proper value in the developing device.

When refresh is performed, sometimes reverse-charged toner generated in the developing device attaches to the transferring part ant this toner pollutes the reverse side of the printing sheet. The pollution of the reverse side of the printing sheet after refresh mode is performed is prevented by a process in which a reverse transfer bias is applied to the transferring part while refresh is performed until the toner on the electrostatic latent image carrier passes the transferring part, and a positive transfer bias is applied to the transferring part after cleaning of the toner on the electrostatic latent image carrier is finished and then the electrostatic latent image carrier is rotated, to have the reverse-charged toner cleaned off.

For effectuation of this, it is preferable that the refresh means has a cleaning means which, at refresh, applies a reverse transfer bias to the transferring part until the toner on the electrostatic latent image carrier passes the transferring part, applies a positive transfer bias after the toner on the electrostatic latent image carrier is cleaned off, and rotates the electrostatic latent image carrier to have the reverse-charged toner cleaned off.

When refresh is necessary, it is suitable, for the sake of performing refresh not when the printing action is finished but when the next printing is directed, to configure so that the print rate is memorized when the print rate of an image or the average print rate of images falls short of the proper print rate, refresh is performed referring to the contents of the memory when the next printing is directed, and then printing is started.

For effectuation of this, an image forming apparatus according the present invention is constructed so that it has a memory which memorizes the print rate when the print rate of an image or the average print rate of images falls short of the proper print rate, and start printing after refresh is performed referring to the contents of the memory when the next printing is directed.

The printed image density differs according to whether alternating electric field of the same strength is applied at image formation and at refresh (Case A) or stronger alternating electric field is applied at refresh than at image formation (Case B).

For example, as shown in FIG. 11, the printed image density of Case A and Case B does not change with increased number of pages until 20000 pages, but over 20000 pages the printed image density of Case A decreases.

DETAILED DESCRIPTION OF THE PREFERRED EMBODIMENTS

A preferred embodiment of the present invention will now be detailed with reference to the accompanying drawings. It is intended, however, that unless particularly specified, dimensions, materials, shapes, relative positions and so forth of the constituent parts described in the embodiment shall be interpreted as illustrative only not as limitative of the scope of the present invention.

Figure 1:
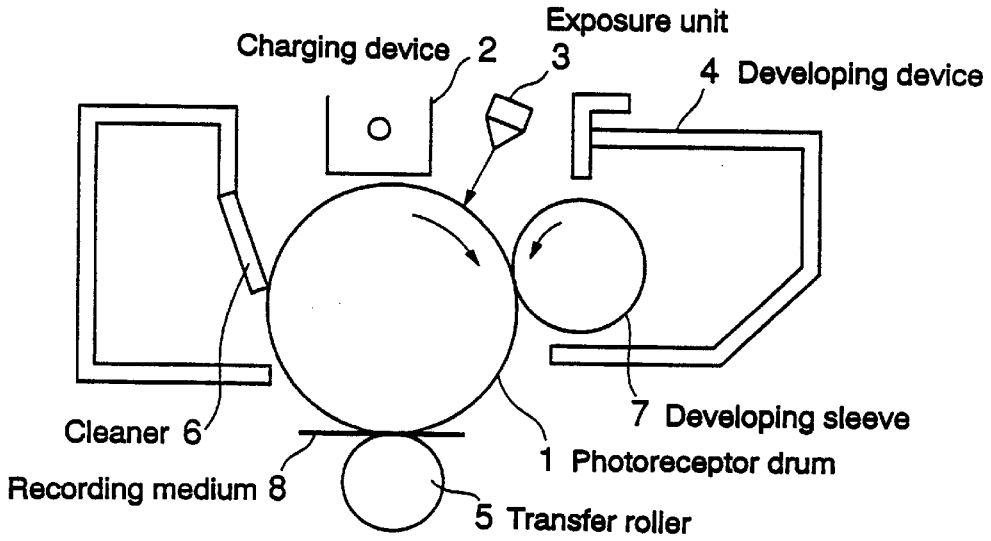
FIG. 1 is a schematic sectional view showing the construction of the principal part of the image forming apparatus according to the present invention.

FIG. 1 is a schematic sectional view showing an embodiment of an image forming apparatus according to the present invention.

In FIG. 1, around a photoreceptor drum 1 made of a-Si are disposed a developing device 4 having a charger 2, an exposing unit 3, and developing sleeve 7, and a transfer roller 5, and a cleaner 6.

The photoreceptor drum 1 and the developing sleeve 7 rotates in the direction of arrow respectively, forming an image on the photoreceptor drum 1. The surface of the a-Si photoreceptor 1 is charged uniformly to about +240 V by the charger 2 and electrostatic latent image is formed thereon by exposing unit 3. The surface potential of the photoreceptor is about +10 V after exposing.

Figure 2:
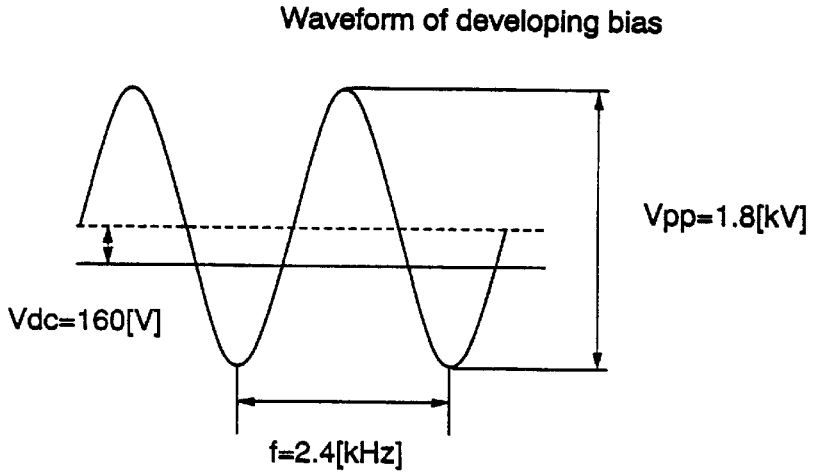
FIG. 2 is a graph showing the waveform of a developing bias.

An alternating electric field (Vdc=160 V, Vpp=1.8 kV, f=2.4 kHz) is applied between the a-Si photoreceptor drum 1 and the developing sleeve 7 to develop a toner image on the exposed part on the photoreceptor drum 1. In FIG. 2 is shown the waveform of developing bias used for the embodiment.

The toner image developed on the photoreceptor drum 1 is transferred by the transfer roller 5 to a recording medium 8 to be fixed by the fixing device not shown disposed in the downstream of the flow of the recording medium 8.

On the transfer roller 5 is applied a negative high voltage bias, voltage of which differs according to the environment, kind and resistance of the recording medium, and so forth.

A positive charging magnetic toner of average grain size 5.0~8.0 $\mu$m is used.

In the image forming apparatus, image data is evaluated as the number of dots, and the print rate $a_n$ defined as the ratio of the number of dots of an image to the number of dots corresponding to a black solid fills image, and the average of the print rate of each image $a_1, a_2, \ldots, a_n$ are computed by a CPU installed in the body not shown.

When the average print rate falls short of 3%, image formation is stopped and an alternating electric field is applied to the toner carrier 7 to let the toner on the developing sleeve 7 jump to the photoreceptor drum 1 in non-image-forming state, consuming the toner on the developing sleeve.

In the embodiment is described the case where the image formation is stopped as soon as the average print rate falls short of 3%, however, when the printing is continuing, the operation mentioned above may be performed after the printing is finished.

The toner carrier has the surface blast treated with definite shaped or indefinite shaped particles, and the AC electric field is a DC voltage superimposed with AC components such as rectangular wave, triangular wave, and sinusoidal wave.

Computation or processing of the print rate of image is processed for every print and the average print rate for a certain number of sheets, for example, 1~500 sheets, is calculated, and the toner is let to jump from the developing sleeve 7, according to the print rate, to consume the toner when the image forming on the photoreceptor 1 is not done (no image formation time) or after the rotation of the electrostatic latent image carrier and the toner carrier is stopped.

The toner attached to the photoreceptor drum 1 during the no image formation time is scraped off with the cleaner 6 as the photoreceptor drum 1 rotates. On this occasion the toner does not attach to the transfer roller 5, as a DC bias voltage of the same polarity with the toner is applied to the transfer roller 5.

That is to say, the AC bias is controlled to consume the toner, after the average print rate is calculated and while the photoreceptor drum 1 which is the electrostatic latent image carrier and the developing sleeve 7 which is the toner carrier are being driven.

Experiments has shown that toner charge-up is liable to occur when the print rate is 3% or lower.

When the print rate is low, it is necessary, as the toner remaining on the developing sleeve increases, to increase the amount of the toner which jumps to the photoreceptor drum 1 by rotating the developing sleeve 7 one or more rotations and prolonging applying period of the AC bias for unsticking the remaining toner on the developing sleeve.

Therefore, while refresh is performed when the print rate falls short of 3%, however, it is preferable to prepare several kinds of refresh mode to respond to situations (environment, etc.).

In the refresh process, toner is more easily consumed by applying an alternating electric field for refresh higher in effective value than applied for image formation.

Figure 3:
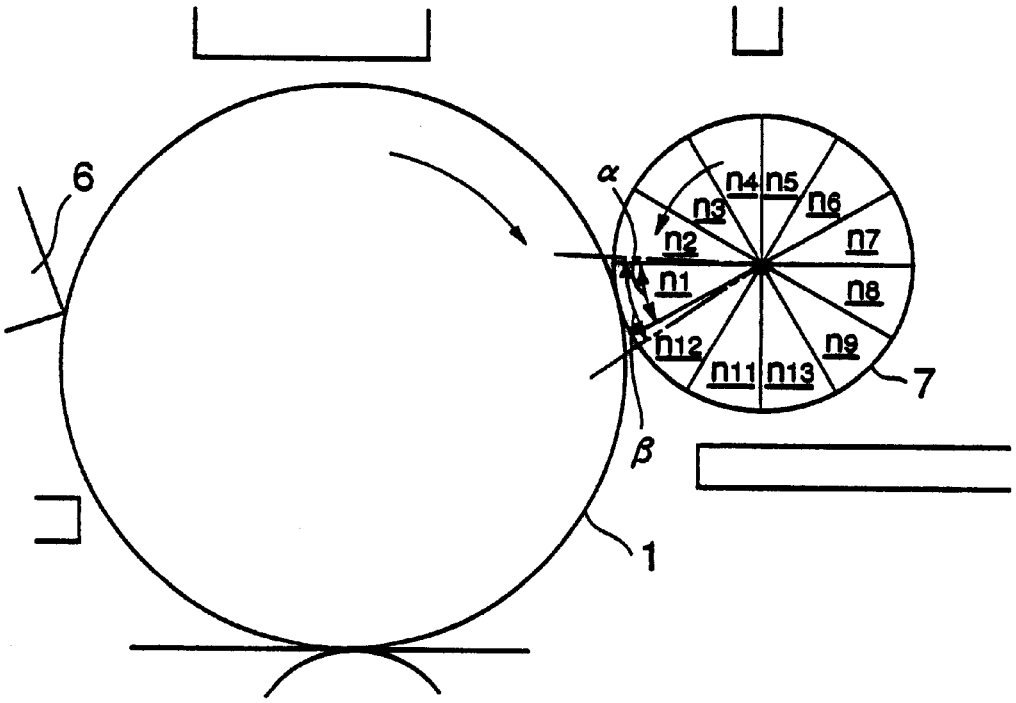
FIG. 3 is a view for illustrating refresh mode.

FIG. 3 illustrates refresh of the surface of the developing sleeve 7 by stopping the rotation of the electrostatic latent image carrier and toner carrier when the average print rate falls short of the proper print rate. The developing sleeve 7 is able to be rotated stepwise by an angle $\alpha$, for example, by an angle of 30° sectioned into $n_1, \ldots n_{12}$, and a rotation control means, not shown, by which to control the rotation of the developing sleeve 7, is configured so as to be able to control the stepwise rotation.

The photoreceptor drum 1 disposed facing the developing sleeve 7 is configured so that the developing sleeve 7 is able to be refreshed over a little wider angle $\beta$ than angle $\alpha$, for example, 35°. Angle $\alpha$ and $\beta$ is as a matter of course not limited to angles described above and for example angle $\alpha$ may be about 180° or the angle between the developing position and the cleaning position on the electrostatic latent image.

Thus, while the developing sleeve 7 is stopped with the section $n_1$ at the position as shown in FIG. 3, the electric field for refresh is applied between the developing sleeve 7 and the photoreceptor 1, and as the photoreceptor drum 1 moves in a clockwise direction the section $n_1$ on the developing sleeve 7 is refreshed, and the toner jumped and attached to the photoreceptor drum 1 is scraped off with the cleaner 6.

This procedure is followed one after another over the section $n_1$ to $n_2$ to complete the refresh.

In a case where angle $\alpha$ is set to the angle between the developing position and the cleaning position on the electrostatic latent image carrier, the developing sleeve 7 is refreshed over the range corresponding to the angle in one process, and so repetition of this process for a certain period of time enhances the effect and in this case the refresh may be able to be completed in a rotation of the photoreceptor drum 1.

It is suitable that, for the sake of preventing the pollution of the reverse side of the recording sheet with reverse-charged toner, a transfer reverse bias (same polarity with the toner) is applied to the transfer roller 5 until the toner on the electrostatic latent image carrier passes the transfer zone, a transfer positive bias (reverse polarity to the toner) is applied to the transfer zone after the toner on the electrostatic latent image carrier is cleaned, and the electrostatic latent image carrier is rotated to clean the reverse-charged toner, when refresh is performed.

Next, the operation of the embodiment is described with reference to FIG. 4.

At the first step when a user uses the image forming apparatus, the counting means, not shown, of the number of pages of the recording medium is reset (50). After start, the number of dots of a page is counted and the print rate thereof is calculated, and the sum of the print rate and cumulative average print rate are memorized (51).

Even if the number of pages copied reaches set number (64 sheets), if the average print rate is not under 3% (53), page number counter is reset but the computation of the cumulative average print rate is kept continuing to renew the cumulative average print rate.

When, continuing copying, if the average print rate falls short of 3% after repetition of counts of 64, the print rate is evaluated. When the average print rate is under 0.5% the alternating bias is applied for 15.0 sec (55), when the rate is 0.5% and over but under 1% the bias is applied for 12.9 sec (57), when the rate is 1% and over but under 2% the bias is applied for 10.5 sec (59), and when the rate is 2% and over but under 3% the bias is applied for 5.2 sec (61).

Figure 4:
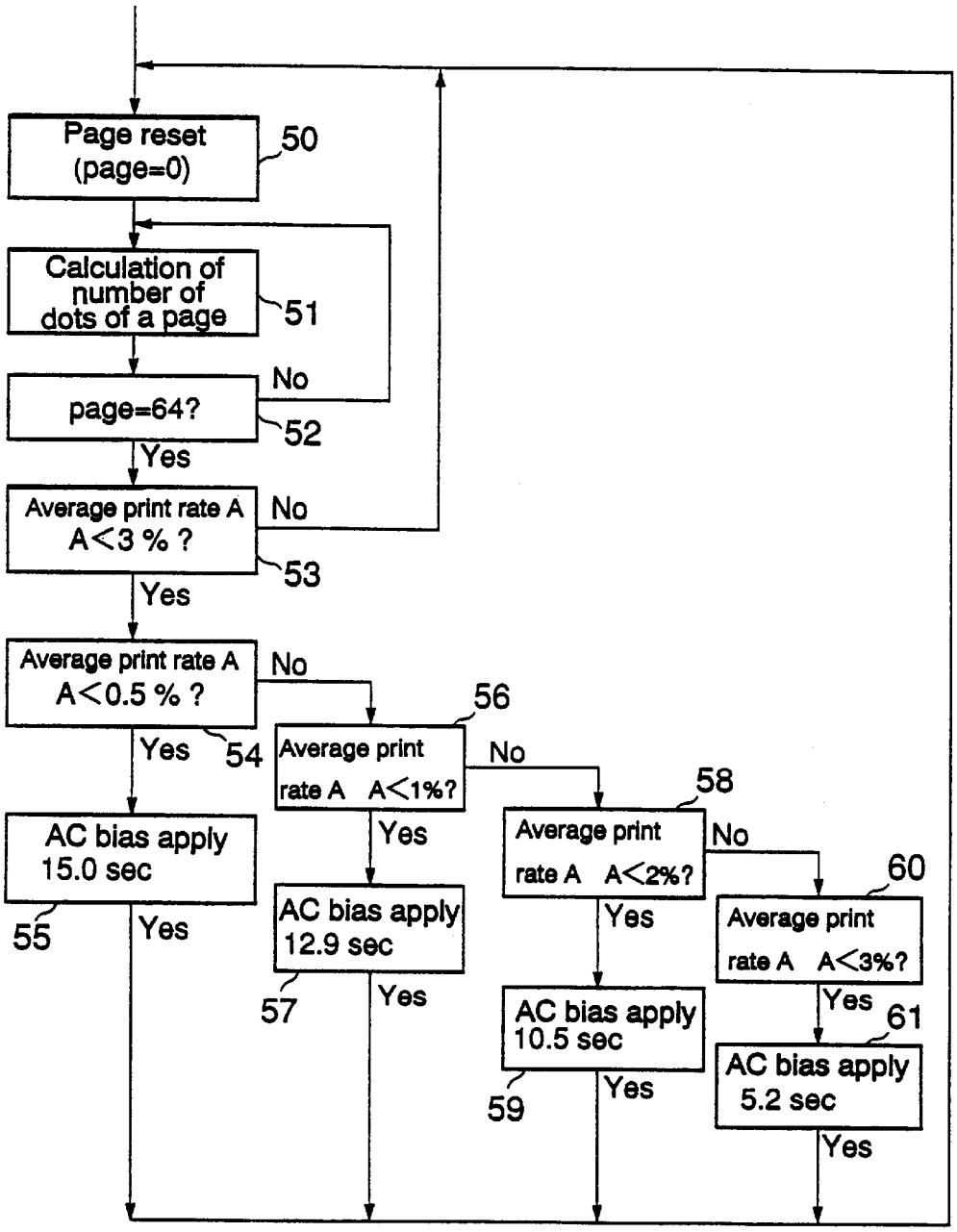
FIG. 4 is a flow diagram according to the present invention.
Figure 5:
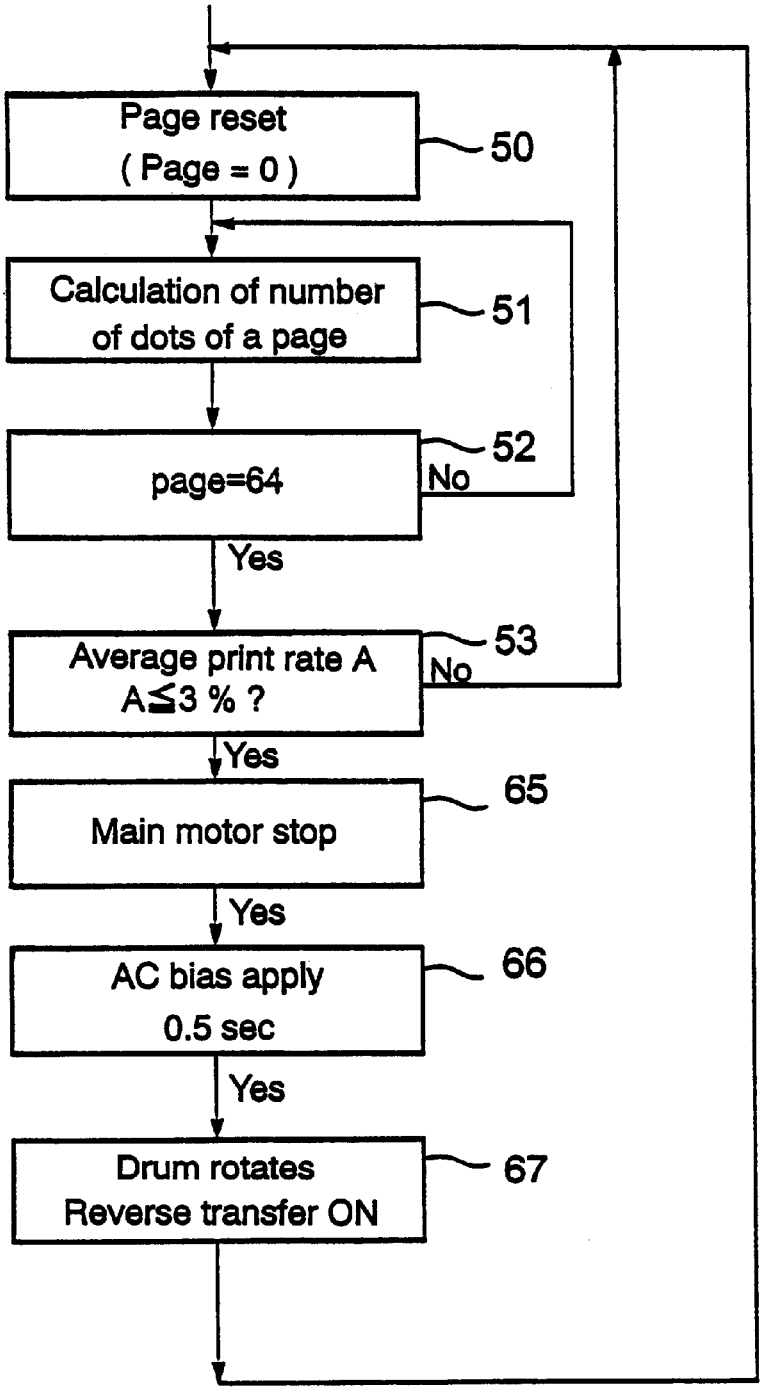
FIG. 5 is a flow diagram in a case where toner refresh is performed after stopping the rotation of the electrostatic latent image carrier and the toner carrier.

FIG. 5 is a flow diagram in a case where the refresh of the surface of the developing sleeve is performed with the electrostatic latent image carrier and the toner carrier stopped of rotation. The same process as that in FIG. 4 is marked with the same reference numeral.

In FIG. 5, processes after the step 53 in FIG. 4 follow the steps "Main motor stop" (65), "AC bias apply 0.5 sec" (66), and "Drum rotates, Reverse transfer ON" (67).

At the first step when a user uses the image forming apparatus, the counting means, not shown, of the number of page of the recording medium is reset (50). After start, the number of dots of every page is counted and the print rate thereof is calculated, and the sum of the print rate and cumulative average print rate are memorized (51).

Even if the number of pages copied reaches set number (64 sheets), if the average print rate is not under 3% (53), page number counter is reset but the computation of the cumulative average print rate is kept continuing to renew the cumulative average print rate.

When, continuing copying, if the average print rate falls short of or equal to 3% after repetition of counts of 64, the main motor, not shown, with which to drive the photoreceptor drum 1 and developing sleeve 7 is stopped (65), the alternating bias is applied for 0.5 sec (66), the DC bias of the same polarity with the toner is applied and the photoreceptor drum 1 is rotated (67) to be scraped off of the toner thereon.

This process is performed over the section $n_1, \ldots n_{12}$ on the developing sleeve 7 as shown in FIG. 3 one after another to complete the refresh of the developing sleeve 7.

The refresh may be performed so that firstly the refresh of the section $n_1$ is performed and next any of the $n_2$~$n_{12}$ section is performed and so on.

Figure 6:
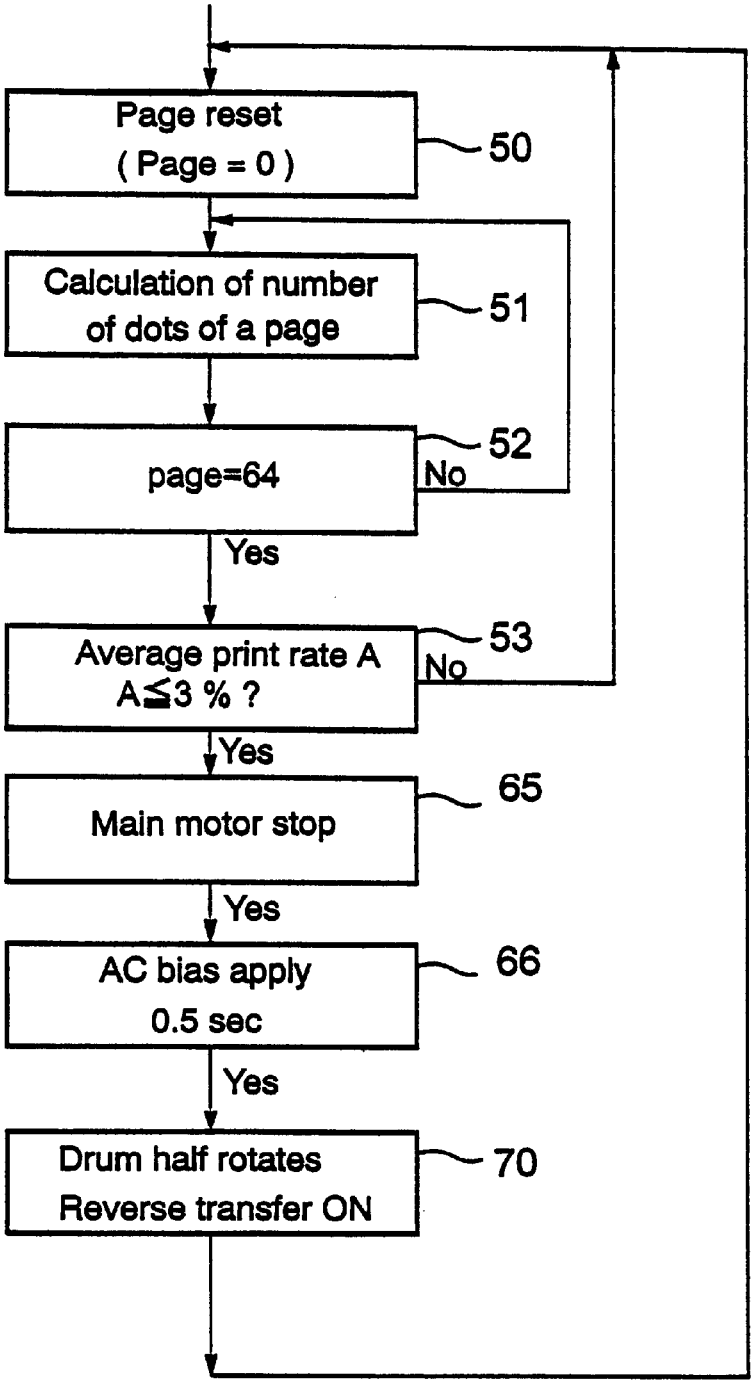
FIG. 6 is a flow diagram in a case where toner refresh is performed by rotating the toner carrier by half a rotation.

FIG. 6 is a flow diagram in a case where refresh is performed by rotating the developing sleeve half a rotation. The same process as that in FIG. 5 is marked with the same reference numeral. The process 67 "Drum rotates, Reverse transfer ON" in FIG. 5 is changed in FIG. 6 to the process 70 "Drum half rotates, Reverse transfer ON". So in this case, the refresh in which after the alternating bias is applied for 0.5 sec in the process 66, the transfer roller 5 is applied with the DC bias of the same polarity as the toner, and the developing sleeve 7 is rotated half a rotation, is repeated for a certain period of time.

Figure 7:
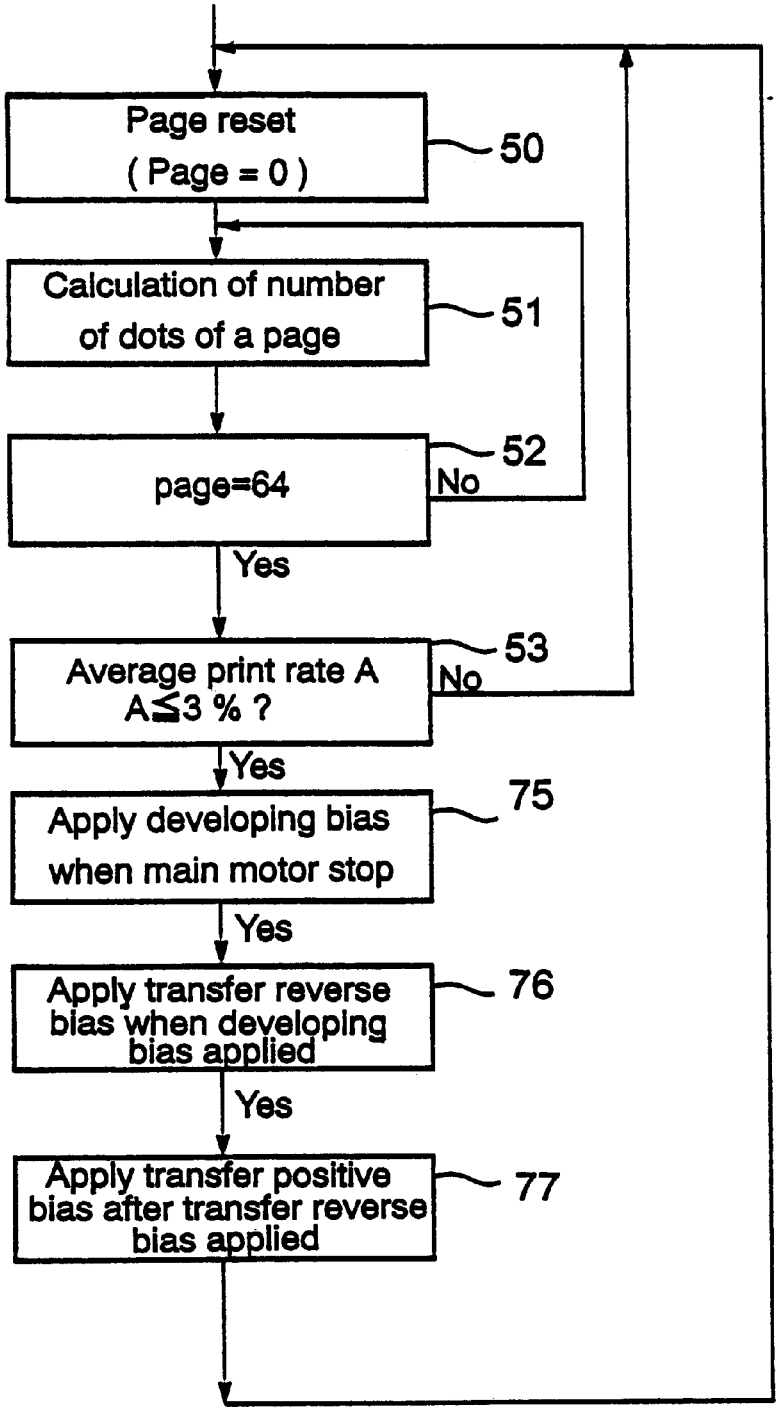
FIG. 7 is a flow diagram in a case where refresh which prevents pollution of the reverse side of a printed sheet.

FIG. 7 is a flow diagram in a case where the pollution of the reverse side of the printing sheet after refresh is also prevented. The same process as that in FIG. 4 and FIG. 5 is marked with the same reference numeral.

In FIG. 7, processes after step 54 "Average print rate A, A<0.5%?" in FIG. 4 and processes after step 65 "Main motor stop" in FIG. 5 are changed to step 75 "Apply developing bias when main motor stop", step 76 "Apply transfer reverse bias when developing bias applied", and step 77 "Apply transfer positive bias after transfer reverse-bias applied".

In FIG. 7, when the average print rate becomes 3% or less at step 53, then at step 75, the main motor, not shown, with which to drive the photoreceptor drum 1 and developing 7, is stopped and the alternating bias is applied for proper period of time according to step 54 to 61 in the flow diagram shown in FIG. 4. Then at step 76, the DC bias of same polarity as the toner is applied to the transfer roller 5 to prevent the normal-charged toner from being attached to the transfer roller, continuing this state until the cleaning of the photoreceptor is finished, and lastly at step 77 the transfer normal-bias is no applied to the transfer roller 5 and the photoreceptor drum 1 is rotated to clean off the reverse-charged toner, thus refresh is completed.

Figure 8:
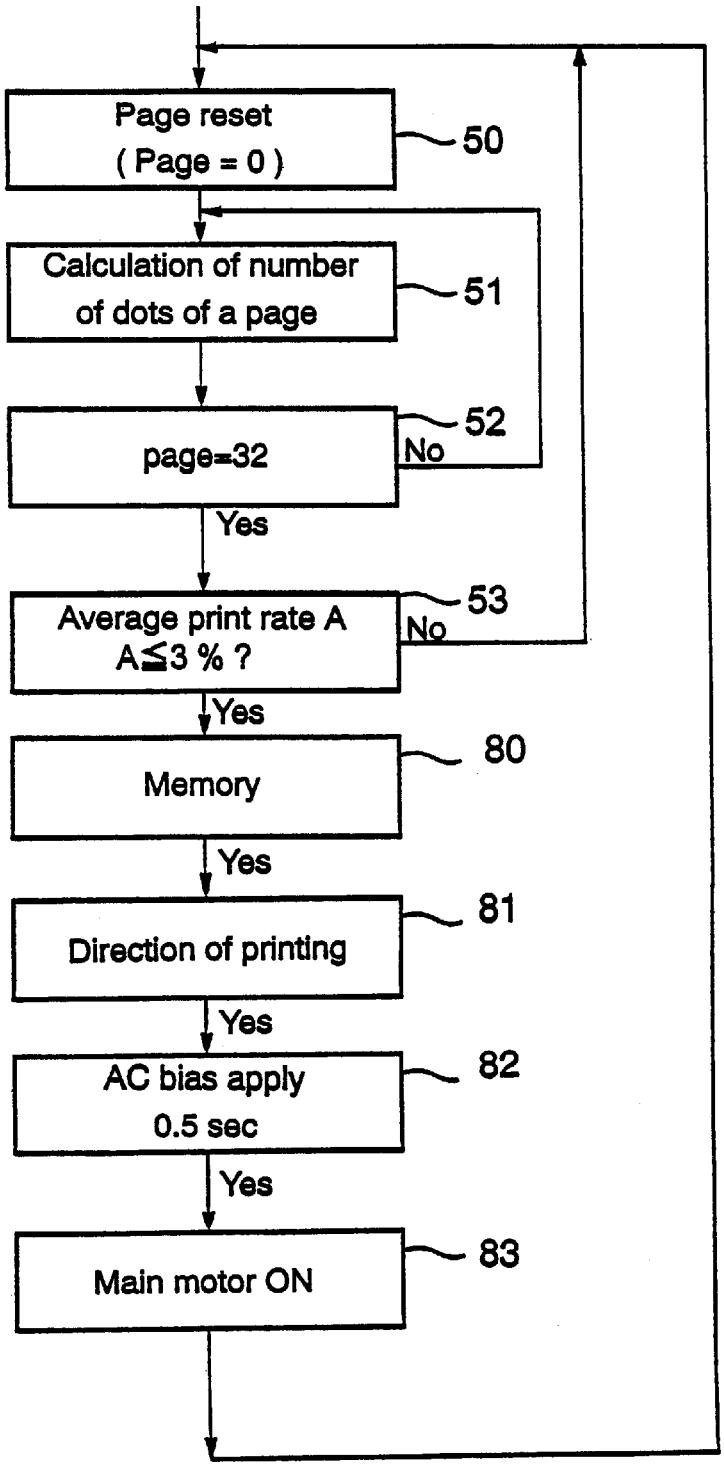
FIG. 8 is a flow diagram in a case where toner refresh is performed in advance of the next printing.

FIG. 8 is a flow diagram in a case where the print rate of an image or average print rate falls short of the proper print rate, refresh is performed in advance of the printing. The same process as that in FIG. 4 and FIG. 5 is marked with the same reference numeral. In FIG. 8, processes after step 54 "Average print rate A, A<0.5%?" in FIG. 4 and processes after step 65 "Main motor stop" in FIG. 5 are changed to step 80 "Memory", step 81 "Direction of printing", step 82 "Apply AC bias, 0.5 sec", and step 83 "Main motor ON".

In FIG. 8, when the average print rate becomes 3% or less at step 53, the print rate is memorized in the memory at step 80, and when after the present printing finished and the next printing is directed at step 81, the necessity of refresh, referring to the contents of the memory, is send to the controller not shown. At step 82 an alternating bias is applied for a proper period of time to perform refresh and then the apparatus goes into usual printing.

EXAMPLE 1

In the embodiment, the average print rate A was computed for every 64 sheets, and the toner refresh mode was put into effect after the 64th sheet was printed out.

To consume the toner through letting the toner jump from the developing sleeve 7 to the photoreceptor drum 1 on the zone where no image is formed (i.e., when image is not formed), the surface of the photoreceptor drum 1 is held in uncharged state, and an alternating bias was applied to consume the toner according the print rate.

The alternating bias was set to: Vdc=160 V, Vpp=1.8 kV, f=2.4 kHz. When the alternating bias was applied, a high voltage bias of positive polarity was applied to the transfer roller 5 to prevent the toner from attaching to the transfer roller 5.

The linear speed of the photoreceptor was set to 71 mm/sec.

It has been ascertained that 400 mg of toner was developed on the photoreceptor drum 1 when the image forming apparatus used in the experiment printed black solid fills of 200 mm×287 mm on a A-4 size sheet, so the consumption of toner for solid fills image was 0.7 mg/cm$^2$. On the basis of this value, the duration of application of the alternating bias set according to each print rate was applied on the condition that light or pale print does not occur.

Table 1 shows those set values on the embodiment.

In Table 1 was shown the toner consumption and the applied duration of the alternating bias in toner refresh mode, according to the print rate A.

TABLE 1

| Print Rate A (%) | Toner Consumption to No-image Area (mg) | Application Duration of Alternating Bias (sec) |
|---|---|---|
| A < 0.5 | 1485 | 15.0 |
| 0.5 ≦ A < 1.0 | 1280 | 12.9 |
| 1.0 ≦ A < 2.0 | 1024 | 10.5 |
| 2.0 ≦ A < 3.0 | 512 | 5.2 |
| 3.0 ≦ A < 4.0 | 0 | 0 |
| 4.0 ≦ A < 5.0 | 0 | 0 |
| 5.0 ≦ A < 10 | 0 | 0 |
| 10 ≦ A | 0 | 0 |

The data obtained from the experiment with the condition as shown above are plotted with the image density ID as coordinate and the number of printed page as abscissa; image density ID refers to MACBETH Density in which white is 0.00 and pitch black is 1.8.

Figure 9:
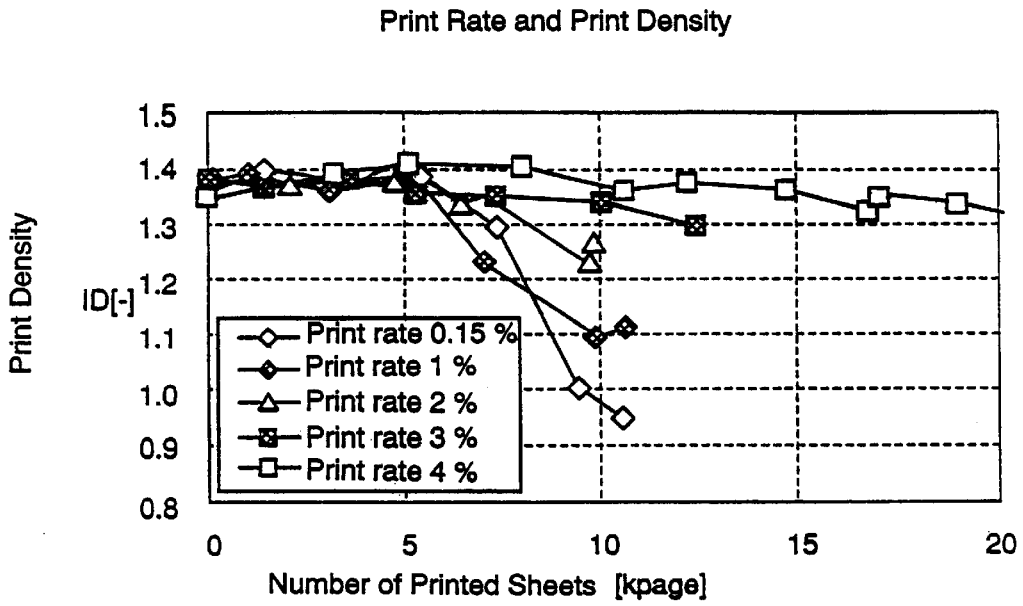
FIG. 9 is a graph showing the change of print density depending on print rate.

In FIG. 9 is shown the change in print density with increased number of pages for each print rate. As is seen from the figure, rapid decrease of image density in print evaluation occur when the print rate falls short of 3%.

Figure 10:
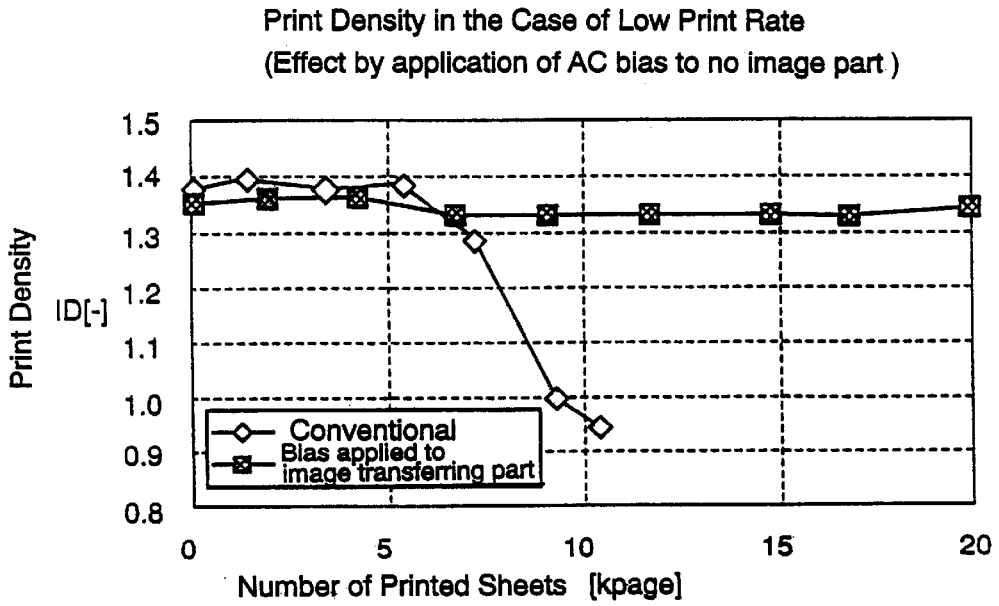
FIG. 10 is a graph showing the change of print density in the case of low print rate printing.

In FIG. 10 is shown the result when the toner was consumed through applying alternating bias according to print rate while image was not formed. As is seen from the figure, good image density in print evaluation is maintained.

EXAMPLE 2

Differences from the example 1 are described below:

An alternating electric field of effective voltage Vrsm 0.64 kV (Vdc=160 V, Vpp=1.8 kV, f=2.4 kHz) was applied between the a-Si photoreceptor 1 and the developing sleeve 7 to develop the toner on the part of the photoreceptor drum 1 exposed to light. The developed toner was transferred to the recording medium 8 by the transfer roller 5 and fixed by the fixing device not shown to output the printed sheet.

In the apparatus, document with print rate of 0.15% were printed and the alternating electric field was applied for 15.0 sec to the developing sleeve 7 when the image forming was not performed after every time 64 sheets were output to consume the toner.

Below, conditions of alternating biases when image forming was not performed are described:

Condition 1: Vdc=160 V, Vpp=1.8 kV, f=2.4 kHz, Sinusoidal wave (same as when image forming)

Condition 2: Vdc=160 V, Vpp=2.0 kV, f=1.2 kHz, Sinusoidal wave

Condition 3: Vdc=160 V, Vpp=1.4 kV, f=1.2 kHz, Rectangular wave

The effective voltage of each condition being denoted respectively as Vrsm1, Vrsm2, and Vram3, then, Vrsm1=0.64 kV Vrsm2=0.71 kV Vrsm3=0.70 kV and so, Vrsm1<Vrsm2, Vrsm3.

The result of the experiment with above conditions were plotted with image density as coordinate and number of printed sheets as abscissa.

Figure 11:
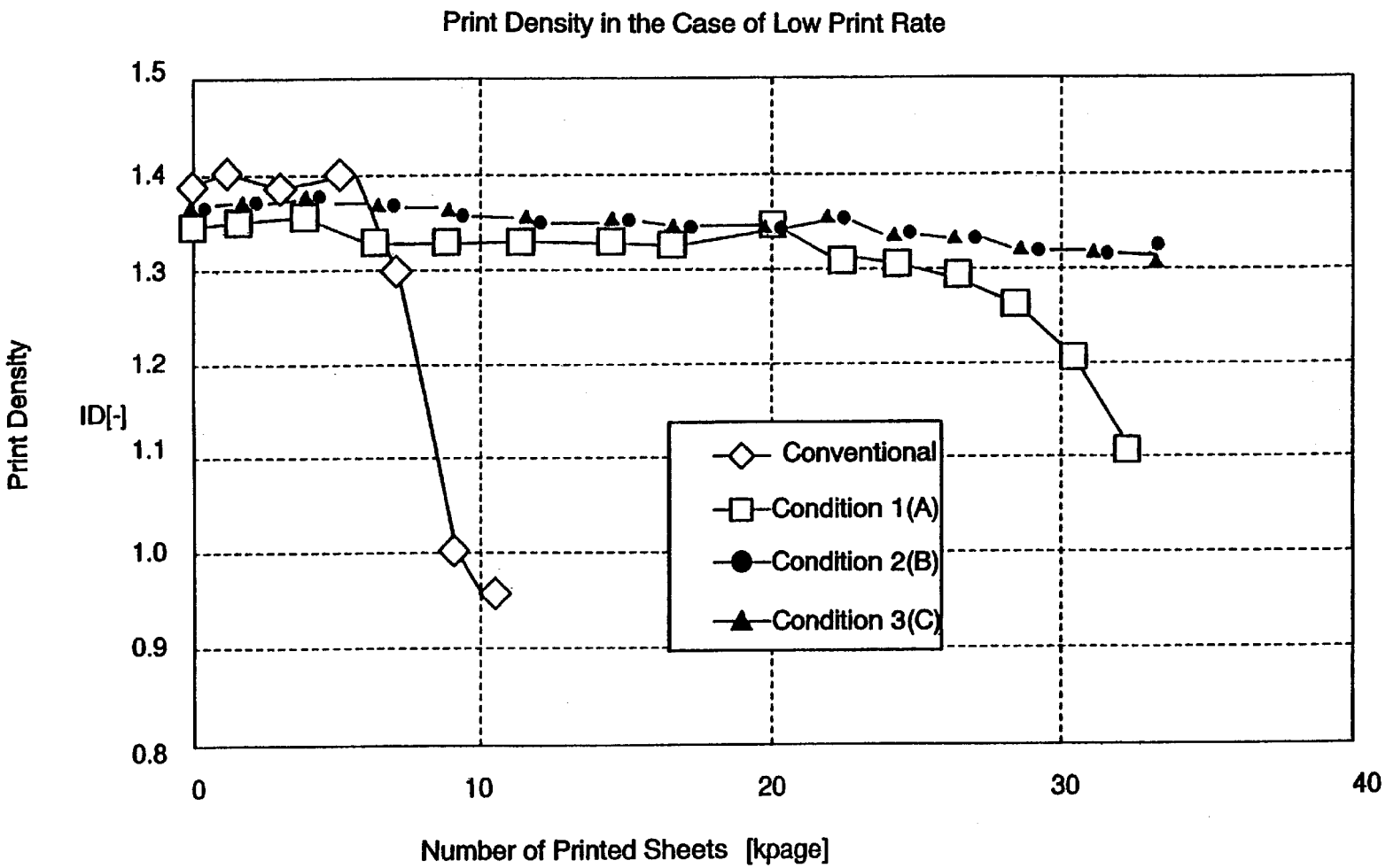
FIG. 11 is a graph showing the change of print density in the case of low print rate printing.

FIG. 11 shows the result in the case of condition 1~3, which shows the change of image density when print rate is low.

Image densities do not differ according to alternating electric field of condition 1~3 until the number of printed sheets are 20000 sheets, but over 20000 sheets the image density of condition 1 decreases. At 35000 sheets, the image densities with alternating electric field of condition 2, 3 are 1.3 compared to 1.1 with alternating electric field of condition 1.

Thus, it is clear that by applying in refresh process an alternating electric field of which the effective voltage is higher than applied when image forming is being carried on, reduction in image density is prevented even when the number of printed pages increases.

EXAMPLE 3

Below, the third embodiment where refresh of the surface of the developing sleeve 7 was performed stopping the rotation of the electrostatic latent image carrier and toner carrier.

In the image forming apparatus, a toner refresh mode was performed, in which image pattern was measured as dots for each image by a CPU provided in the body, cumulative average print rate A was computed every time 64 images were measured.

When the average print rate fell short of 3%, the main motor was stopped of the rotation, and then the alternating electric field was applied.

In the embodiment, the photoreceptor drum 1 was rotated with linear speed of 169 mm/sec after the main motor was stopped of the rotation.

With changed duration of application of the alternating electric field, toner consumption was measured by scraping off the toner attached onto the photoreceptor drum 1 and measuring the weight, and also the state of remaining toner on the toner carrier was checked.

In Table 2, the relation of application duration of alternating bias to the consumption of the toner is shown.

TABLE 2

| Application Duration (msec) | Toner Consumption (mg) | State of Toner Carrier |
|---|---|---|
| 10 | 7 | toner remains |
| 30 | 7 | toner remains |
| 50 | 10 | remains no toner |
| 100 | 10 | remains no toner |
| 500 | 10 | remains no toner |

As is seen from Table 2, the optimum range of application duration for scraping off the toner is over 50 msec.

Figure 12:
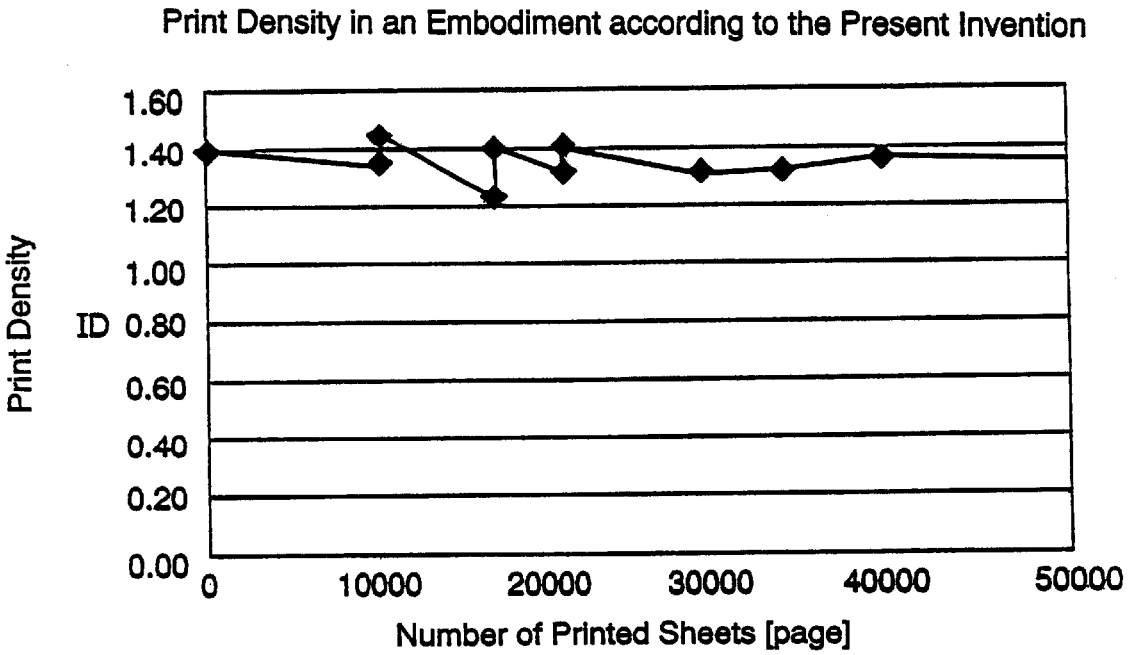
FIG. 12 is a graph showing the change of print density in the case of low print rate printing in the third example.
Figure 13:
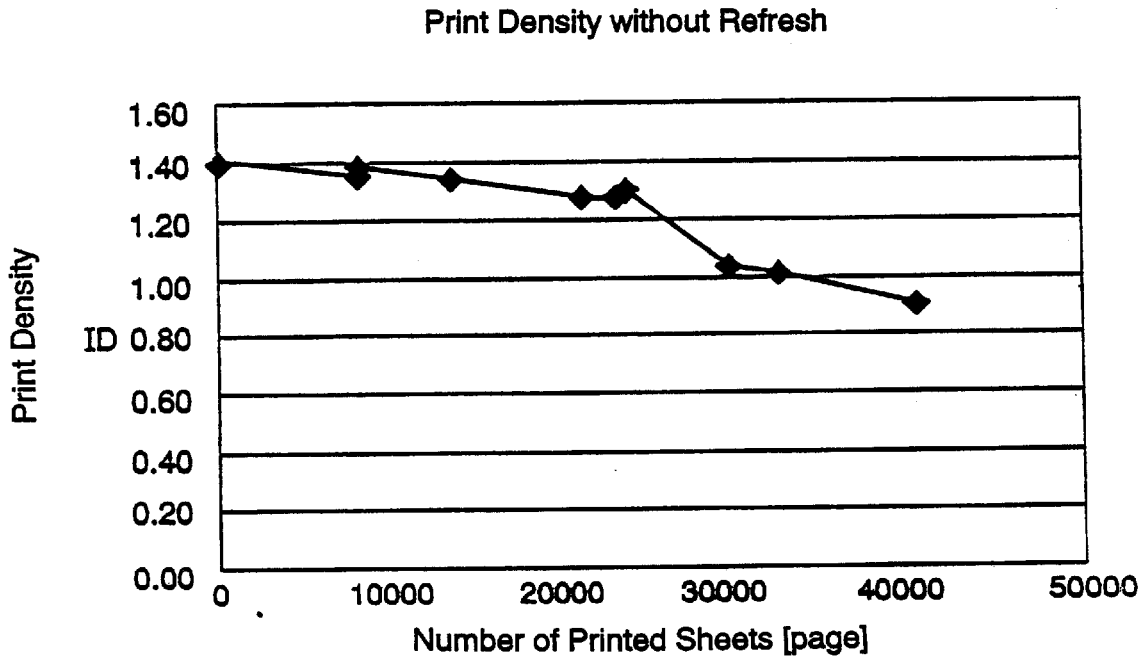
FIG. 13 is a graph showing the change of print density in the case of low print rate printing in an example for comparison.

FIG. 12 shows the change of the image density with increased number of pages in the case of the embodiment, and for comparison's sake, FIG. 13 shows the change of the image density in the case without refresh, each with image density ID as coordinate and the number of pages as abscissa.

As is seen from the figures, when refresh was performed (FIG. 12), the image density ID of 1.4 is kept unchanged until 40000 pages, but when refresh was not performed (FIG. 13), the image density ID decreases in the range over 20000 pages.

Thus, it is clear that the effect of refresh of the embodiment is sufficient.

Accordingly, it is recognized from the result in the case of the first embodiment that to refresh when the print rate falls short of 3% is effective.

It is recognized from the result in the case of the third embodiment that to refresh by applying an alternating bias to the photoreceptor drum with the main motor stopped to stop the toner carrier is effective.

As described above, according to the present invention, the number of dots forming the electrostatic latent image on the electrostatic latent image carrier corresponding to the actual image pattern is counted; a print rate defined as the ratio of the number of black dots used for the actual image pattern to that used when all pages are black solid fills is obtained; the surface of the toner carrier is cleaned by the refresh means which refreshes the surface of the toner by making the toner thereon jump to the electrostatic latent image carrier after the transfer of the toner image on the electrostatic latent image carrier to the recording medium is executed, when the print rate of the actual image pattern falls short of the proper print rate; and the toner attached to the surface of the electrostatic latent image carrier is cleaned by cleaning means for the electrostatic latent image carrier.

Accordingly, the residual toner on the surface of the toner carrier is cleaned off by refresh and uniformly charged thin layer of toner is able to be formed thereon, thus an image forming process and an image forming apparatus are offered, wherein the grain distribution on the surface of the toner carrier does not vary for long use and image defectiveness such as low image density and fog are eliminated.

Also, by configuring so as to control the application duration of alternating electric field for refresh, the alternating electric field for refresh is able to be applied for optimum duration of time according to the print rate of actual images.

Also, by applying an alternating electric field for refresh higher in effective voltage than applied when an image is formed, satisfactory print is obtained even when document of low print rate is copied continuously for an extended period of time.

Also, economical refresh with low consumption of toner is able to be performed by the refresh means when the print rate of actual images falls short of the proper print rate, in which it means the toner on the part of the toner carrier facing the electrostatic latent image carrier is made to jump to the electrostatic latent image carrier, while stopping the rotation of the electrostatic image carrier and the toner carrier after the toner image on the electrostatic latent image carrier is transferred to the recording medium; and as sometimes only the outer layer of the toner on the developing sleeve is able to be removed while the sleeve is rotating if the toner remains thick on the sleeve, by applying bias when the main motor is stopped, the toner is removed from the surface layer to the strongly charged layer next to the surface of the sleeve.

By the process in which the refresh is performed every time the sleeve rotates a proper angle, the refresh may be able to be completed and influence to the electrostatic latent image carrier is small.

By performing the refresh when the sensors provided in the developing device detect higher temperature and humidity than a proper value for each, reduction in image density caused by cohesion of excess charged toner and/or flocculation like soft cake by heat and a phenomenon which reduces image density because of insufficient charge of the toner caused by electric leak effected by water in high humid atmosphere can be prevented.

By performing the refresh process in a way in which, while refresh is performed, transfer reverse bias is applied to the transfer part until the toner on the electrostatic latent image carrier passes the transfer part, and after cleaning of the toner on the electrostatic latent image carrier is finished, a transfer positive bias is applied to the transfer part, and then the electrostatic latent image carrier is rotated to clean out the reverse-charged toner, the pollution of the reverse side of the recording sheet caused by the reverse-charged toner generated in the developing device and attached to the transfer part, is prevented.

By performing the refresh process just before starting of the next print operation not when the necessity is recognized, mislead of users to think if the apparatus is out of order is prevented.

By making it possible to perform the refresh according to direction from the front panel or computer, users can perform the refresh whenever they recognized low print density.

What is claimed is:

1. An image forming process, in an image forming apparatus having a toner carrier which faces an electrostatic latent image carrier and carries toner to the developing zone thereon, provided with a refresh process in which an alternating electric field for refresh is applied between said electrostatic latent image carrier and said toner carrier to refresh the surface of said toner carrier by carrying the toner on said toner carrier to said electrostatic latent image carrier side when the image is not transferred to a recording medium, wherein:

said refresh process is performed in a case where print rate of image falls short of proper print rate.

2. An image forming process according claim 1, wherein duration of application of said alternating electric field for refresh is controlled according to the print rate of image.

3. An image forming process according to claim 1 wherein said alternating electric field for refresh is higher in effective value than an alternating electric field which is applied between said electrostatic image carrier and said toner carrier when an image is formed.

4. An image forming process according to claim 1 wherein said print rate of image or said average print rate is memorized in a memory when it falls short of the proper print rate, said refresh process is performed before start of next printing with reference to said memory when said next printing is directed, and then said next printing is started.

5. An image forming process according to claim 1 wherein said proper print rate is 3%.

6. An image forming process according to claim 1 wherein refresh process is performed when the temperature in the developing device in the apparatus exceeds a certain proper temperature.

7. An image forming process according to claim 1 wherein while refresh is performed, a transfer reverse bias is applied to transfer part until the toner on said electrostatic latent image carrier passes the transfer part, and after cleaning of the toner on said electrostatic latent image carrier is finished a transfer positive bias is applied and said electrostatic latent image carrier is rotated to clean reverse-charged toner.

8. An image forming process according to claim 1 wherein image data is measured as the number of dots by a CPU provided in the apparatus to compute print rate of the image.

9. An image forming process according to claim 1 wherein the refresh process is performed when electric source is on.

10. An image forming process according to claim 1 wherein the refresh process can be performed by command from a control panel.

11. An image forming process, in an image forming apparatus having a toner carrier which faces an electrostatic latent image carrier and carries toner to the developing zone thereon, provided with a refresh process in which an alternating electric field for refresh is applied between said electrostatic latent image carrier and said toner carrier to refresh the surface of said toner carrier by carrying the toner on said toner carrier to said electrostatic latent image carrier side when the image is not transferred to a recording medium, wherein the number of pages of the recording medium is counted;

print rate of image is processed numerically and average print rate is obtained;

proper number of pages is calculated and when said average print rate falls short of the proper print rate, said refresh process if performed.

12. An image forming process according to claim 11 wherein duration of application of said alternating electric field for refresh is controlled according to said average print rate.

13. An image forming process according to claim 11 wherein said alternating electric field for refresh is higher in effective value than an alternating electric field which is applied between said electrostatic image carrier and said toner carrier when image is formed.

14. An image forming process according to claim 11 wherein said print rate of image or said average print rate is memorized in a memory when it falls short of the proper print rate, said refresh process is performed before start of next printing with reference to said memory when said next printing is directed, and then said next printing is started.

15. An image forming process according to claim 11 wherein refresh process is performed when temperature in the developing device in the apparatus exceeds a certain proper temperature.

16. An image forming process according to claim 11 wherein while refresh is performed, a transfer reverse bias is applied to transfer part until the toner on said electrostatic latent image carrier passes the transfer part, and after cleaning of the toner on said electrostatic latent image carrier is finished a transfer positive bias is applied and said electrostatic latent image carrier is rotated to clean reverse-charged toner.

17. An image forming process according to claim 11 wherein image data is measured as the number of dots by a CPU provided in the apparatus to compute print rate of the image.

18. An image forming process according to claim 11 wherein the refresh process also can be performed by command from a front panel.

19. An image forming apparatus provided with a toner carrier which faces an electrostatic latent image carrier and carries toner to the developing zone thereon, and performs refresh of the toner on said toner carrier when image transfer to a recording medium is not executed, further comprising a print rate processing means which numerically processes print rate corresponding to image pattern; and a refresh means which applies an alternating electric field for refresh between said electrostatic latent image carrier and said toner carrier to carry toner on the said toner carrier to said electrostatic latent image carrier side when said print rate falls short of proper print rate.

20. An image forming apparatus according to claim 19 wherein said refresh means which controls duration of application of said alternating electric field according to degree of said print rate.

21. An image forming apparatus according to claim 19 wherein said alternating electric field for refresh is higher in effective value than an alternating electric field which is applied between said electrostatic image carrier and said toner carrier when image is formed.

22. An image forming apparatus according to claim 19 wherein a memory memorizes said print rate of image or said average print rate or said average print rate when it falls short of the proper print rate, and a refresh means which includes a means which directs so as printing be started after said refresh process is performed with reference to the content of said memory when next printing is directed.

23. An image forming apparatus according to claim 19 wherein said proper print rate is 3%.

24. An image forming apparatus according to claim 19 wherein sensors for measuring temperature and humidity are provided in the developing device in the apparatus, and a means is provided, which allows refresh to be performed when said sensors detect temperature and humidity in the developing device exceeds each proper value.

25. An image forming apparatus according to claim 19 wherein said refresh means includes a means which applies a transfer reverse bias to transfer part until the toner on said electrostatic latent image carrier passes the transfer part, and applies transfer positive bias to the transfer part after cleaning of the toner on said electrostatic latent image carrier is finished, and rotates said electrostatic latent image carrier to clean reverse-charged toner.

26. An image forming apparatus according to claim 19 wherein print rate of image is measured by a CPU which is configured to compute print rate of image as the number of dots of image data.

27. An image forming apparatus according to claim 19 wherein a means is provided, which allows refresh to be performed when electric source is on.

28. An image forming apparatus according to claim 19 wherein a means is provided which allows refresh to be performed by command from a control panel.

29. An image forming apparatus provided with a toner carrier which faces an electrostatic latent image carrier and carries toner to the developing zone thereon, and performs refresh of the toner on said toner carrier when image transfer to a recording medium is not executed, further comprising a counting means for counting the number of pages of the recording medium;

an average print rate processing means for obtaining average print rate by numerically processing print rate corresponding to image pattern; and a refresh means which applies an alternating electric field for refresh between said electrostatic latent image carrier and said toner carrier to carry toner on the said toner carrier to the said electrostatic latent image carrier side when said print rate falls short of proper print rate; and said refresh means is actuated in a case where the average print rate calculated by said average print rate processing means falls short of proper print rate when proper number of pages is counted.

30. An image forming apparatus according to claim 29 wherein an application duration control means which controls application duration of said alternating electric field for refresh for carrying toner on the said toner carrier to the said electrostatic latent image carrier side is provided, and duration of application of said alternating electric field is controlled according to said average print rate.

31. An image forming apparatus according to claim 29 wherein said alternating electric field for refresh is higher in effective value than an alternating electric field which is applied between said electrostatic image carrier and said toner carrier when image is formed.

32. An image forming apparatus according to claim 29 wherein a memory memorizes said print rate of image or said average print rate or said average print rate when it falls short of the proper print rate, and a refresh means which includes a means which directs so as printing be started after said refresh process is performed with reference to the content of said memory when next printing is directed.

33. An image forming apparatus according to claim 29 wherein sensors for measuring temperature and humidity are provided in the developing device in the apparatus, and a means is provided, which allows refresh to be performed when said sensors detect temperature and humidity in the developing device exceeds each proper value.

34. An image forming apparatus according to claim 29 wherein said refresh means includes a means which applies a transfer reverse bias to transfer part until the toner on said electrostatic latent image carrier passes the transfer part, and applies transfer positive bias to the transfer part after cleaning of the toner on said electrostatic latent image carrier is finished, and rotates said electrostatic latent image carrier to clean reverse-charged toner.

35. An image forming apparatus according to claim 29 wherein print rate of image is measured by a CPU which is configured to compute print rate of image as the number of dots of image data.

36. An image forming apparatus according to claim 29 wherein a means is provided which allows refresh to be performed by command from front panel or computer.

37. An image forming process having a toner carrier which faces an electrostatic latent image carrier and carries toner to developing zone thereon, and a refresh process in which an alternating electric field for refresh is applied between said electrostatic latent image carrier and said toner carrier to refresh the surface of said toner carrier by carrying the toner on said toner carrier to said electrostatic latent image carrier side when the image is not transferred to a recording medium, wherein:

average print rate is obtained every time an image is formed on recording medium; and refresh of the surface of said toner carrier is performed, rotating said electrostatic latent image carrier after application of said alternating electric field for refresh while the rotation of said electrostatic image carrier and said toner carrier being stopped when said average print rate falls short of proper print rate.

38. An image forming process according to claim 37 wherein said average print rate and said proper print rate is compared after images of set number of pages are formed.

39. An image forming process according to claim 37 wherein said alternating electric field is applied for more than 50 msec.

40. An image forming process according to claim 37 wherein said toner carrier is rotated after said electrostatic image carrier is rotated for proper time period to refresh the surface remaining not refreshed of said toner carrier.

41. An image forming process according to claim 40 wherein the surface of said toner carrier is divided with proper center angle, and refresh of the surface of said toner carrier is performed per said division by rotating said toner carrier by said proper angle at a time.

42. An image forming process according to claim 41 wherein the proper angle is the angle from developing position to cleaning position, and refresh by rotating said toner carrier by said angle is repeated for a certain time period.

43. An image forming process according to claims 37 wherein refresh process is performed when temperature in the developing device in the apparatus exceeds a certain proper temperature.

44. An image forming process according to claim 37 wherein while refresh is performed, a transfer reverse bias is applied to transfer part until the toner on said electrostatic latent image carrier passes the transfer part, and after cleaning of the toner on said electrostatic latent image carrier is finished a transfer positive bias is applied and said electrostatic latent image carrier is rotated to clean reverse-charged toner.

45. An image forming process according to claim 37 wherein image data is measured as the number of dots by a CPU provided in the apparatus to compute print rate of the image.

46. An image forming process according to claim 37 wherein the refresh process also can be performed by command from a front panel.

47. An image forming process having a toner carrier which faces an electrostatic latent image carrier and carries toner to developing zone thereon, and a refresh process in which an alternating electric field for refresh is applied between said electrostatic latent image carrier and said toner carrier to refresh the surface of said toner carrier by carrying the toner on said toner carrier to said electrostatic latent image carrier side when the image is not transferred to a recording medium, wherein:

average print rate is obtained every time an image is formed on recording medium;

said average print rate is memorized in a memory when it falls short of proper print rate; and said alternating electric field for refresh is applied to said electrostatic image carrier and said toner carrier before start of next printing with reference to said memory when said next printing is directed, and then said next printing is started.

48. An image forming process according to claim 47 wherein said average print rate and said proper print rate is compared after images of a set number of pages are formed.

49. An image forming process according to claim 47 wherein said alternating electric field is applied for more than 50 msec.

50. An image forming process according to claim 47 wherein said toner carrier is rotated after said electrostatic image carrier is rotated for proper time period to refresh the surface remaining not refreshed of said toner carrier.

51. An image forming process according to claim 50 wherein the surface of said toner carrier is divided with proper center angle, and refresh of the surface of said toner carrier is performed per said division by rotating said toner carrier by said proper angle at a time.

52. An image forming process according to claim 51 wherein the proper angle is the angle from developing position to cleaning position, and refresh by rotating said toner carrier by said angle is repeated for a certain time period.

53. An image forming process according to claim 47 wherein refresh process is performed when temperature in the developing device in the apparatus exceeds a certain proper temperature.

54. An image forming process according to claim 47 wherein while refresh is performed, a transfer reverse bias is applied to transfer part until the toner on said electrostatic latent image carrier passes the transfer part, and after cleaning of the toner on said electrostatic latent image carrier is finished a transfer positive bias is applied and said electrostatic latent image carrier is rotated to clean reverse-charged toner.

55. An image forming process according to claim 47 wherein image data is measured as the number of dots by a CPU provided in the apparatus to compute print rate of the image.

56. An image forming process according to claim 47 wherein the refresh process also can be performed by command from a front panel.

57. An image forming apparatus provided with a toner carrier which faces an electrostatic latent image carrier and carries toner to the developing zone thereon, and performs refresh of the toner on said toner carrier when image transfer to a recording medium is not executed, further comprising an average print rate processing means which computes average print rate corresponding to image pattern every time image formation on recording medium is performed;

a rotation control means to control rotation of said electrostatic latent image carrier and said toner carrier;

a refresh means which applies an alternating electric field for refresh between said electrostatic latent image carrier and said toner carrier to carry toner on said toner carrier, which toner exists on the part thereof facing said electrostatic latent image carrier, to said electrostatic latent image carrier side, while said electrostatic latent image carrier and said toner carrier are stopped of their rotations, when said print rate falls short of proper print rate; and refresh of the surface of said toner carrier is performed, rotating said electrostatic latent image carrier after said alternating electric field for refresh is applied.

58. An image forming apparatus according to claim 57 wherein said average print rate and said proper print rate are compared after images of set number of pages are formed.

59. An image forming apparatus according to claim 57 wherein said refresh means includes said application duration control means for controlling said duration of application of alternating electric field, and said toner carrier is rotated after said electrostatic image carrier is rotated for proper time period to refresh the remaining surface without refresh of said toner carrier.

60. An image forming apparatus according to claim 57 wherein the surface of said toner carrier is divided with proper center angle and said rotation control means includes step advance means to rotate said toner carrier stepwise by said proper angle synchronizing with the end of application of said alternating electric field for refresh.

61. An image forming apparatus according to claim 60 wherein a means is included, which rotates said toner carrier by the angle from the developing position to cleaning position for refresh repeatedly for a certain time period.

62. An image forming apparatus according to claim 57 wherein said alternating electric field is applied for more than 50 msec.

63. An image forming apparatus according to claim 57 wherein sensors for measuring temperature and humidity are provided in the developing device in the apparatus, and a means is provided, which allows refresh to be performed when said sensors detect temperature and humidity in the developing device exceeds each proper value.

64. An image forming apparatus according to claim 57 wherein said refresh means includes a means which applies a transfer reverse bias to transfer part until the toner on said electrostatic latent image carrier passes the transfer part, and applies transfer positive bias to the transfer part after cleaning of the toner on said electrostatic latent image carrier is finished, and rotates said electrostatic latent image carrier to clean reverse-charged toner.

65. An image forming apparatus according to claim 57 wherein print rate of image is measured by a CPU which is configured to compute print rate of image as the number of dots of image data.

66. An image forming apparatus according to claim 57 wherein a means is provided which allows refresh to be performed by command from front panel or computer.

67. An image forming apparatus provided with a toner carrier which faces an electrostatic latent image carrier and carries toner to the developing zone thereon, and performs refresh of the toner on said toner carrier when image transfer to a recording medium is not executed, further comprising an average print rate processing means which computes average print rate corresponding to image pattern every time image formation on recording medium is performed;

a rotation control means to control rotation of said electrostatic latent image carrier and said toner carrier;

a memory to memorize said average print rate when it falls short of proper print rate;

a refresh means which applies an alternating electric field for refresh between said electrostatic latent image carrier and said toner carrier to carry toner on said toner carrier, which toner exists on the part thereof facing said electrostatic latent image carrier, to said electrostatic latent image carrier side, when next printing is directed with reference to the content of said memory; and printing is started after refresh of the surface of said toner carrier, rotating said electrostatic latent image carrier after said alternating electric field is applied.

68. An image forming apparatus according to claim 67 wherein said average print rate and said proper print rate is compared after images of set number of pages are formed.

69. An image forming apparatus according to claim 67 wherein said refresh means includes said application duration control means for controlling said duration of application of alternating electric field, and said toner carrier is rotated after said electrostatic image carrier is rotated for proper time period to refresh the remaining surface without refresh of said toner carrier.

70. An image forming apparatus according to claim 67 wherein the surface of said toner carrier is divided with proper center angle and said rotation control means includes step advance means to rotate said toner carrier stepwise by said proper angle synchronizing with the end of application of said alternating electric field for refresh.

71. An image forming apparatus according to claim 67 wherein sensors for measuring temperature and humidity are provided in the developing device in the apparatus, and a means is provided, which allows refresh to be performed when said sensors detect temperature and humidity in the developing device exceeds each proper value.

72. An image forming apparatus according to claim 67 wherein said refresh means includes a means which applies a transfer reverse bias to transfer part until the toner on said electrostatic latent image carrier passes the transfer part, and applies transfer positive bias to the transfer part after cleaning of the toner on said electrostatic latent image carrier is finished, and rotates said electrostatic latent image carrier to clean reverse-charged toner.

73. An image forming apparatus according to claim 67 wherein print rate of image is measured by a CPU which is configured to compute print rate of image as the number of dots of image data.

74. An image forming apparatus according to claim 67 wherein a means is provided which allows refresh to be performed by command from a front panel or computer.

75. An image forming process in an image forming apparatus having a toner carrier which faces an electrostatic latent image carrier and carries toner to the developing zone thereon, provided with a refresh process in which an alternating electric field for refresh is applied between said electrostatic latent image carrier and said toner carrier to refresh the surface of said toner carrier by carrying the toner on said toner carrier to said electrostatic latent image carrier side when the image is not transferred to a recording medium, wherein:

said refresh process is performed automatically only when print rate of image falls short of proper print rate.

76. An image forming process in an image forming apparatus having a toner carrier which faces an electrostatic latent image carrier and carries toner to the developing zone thereon, provided with a refresh process in which an alternating electric field for refresh is applied between said electrostatic latent image carrier and said toner carrier to refresh the surface of said toner carrier by carrying the toner on said toner carrier to said electrostatic latent image carrier side when the image is not transferred to a recording medium, wherein the number of pages of the recording medium is counted;

print rate of image is processed numerically and average print rate is obtained;

proper number of pages is calculated and said refresh process is performed automatically only when said average print rate falls short of the proper print rate.

77. An image forming apparatus provided with a toner carrier which faces an electrostatic latent image carrier and carries toner to the developing zone thereon, and performs refresh of the toner on said toner carrier when image transfer to a recording medium is not executed, further comprising a print rate processing means which numerically processes print rate corresponding to image pattern; and a refresh means are provided which automatically applies an alternating electric field for refresh between said electrostatic latent image carrier and said toner carrier to carry toner on the said toner carrier to said electrostatic latent image carrier side only when said print rate falls short of proper print rate.

78. An image forming apparatus provided with a toner carrier which faces an electrostatic latent image carrier and carries toner to the developing zone thereon, and performs refresh of the toner on said toner carrier when image transfer to a recording medium is not executed, further comprising a counting means for counting the number of pages of the recording medium;

an average print rate processing means for obtaining average print rate by numerically processing print rate corresponding to image pattern; and a refresh means which applies an alternating electric field for refresh between said electrostatic latent image carrier and said toner carrier to carry toner on the said toner carrier to the said electrostatic latent image carrier side when said print rate falls short of proper print rate; and said refresh means is actuated automatically only when the average print rate calculated by said average print rate processing means falls short of proper print rate when proper number of pages is counted.

* * * * *